US008770306B2

(12) United States Patent
Ide et al.

(10) Patent No.: US 8,770,306 B2
(45) Date of Patent: Jul. 8, 2014

(54) INERT GAS INJECTION TO HELP CONTROL OR EXTINGUISH COAL FIRES

(75) Inventors: Suguru T. Ide, Emerald Hills, CA (US); Franklin M. Orr, Jr., Stanford, CA (US); Kyle G. Siesser, Ignacio, CO (US); William B. Flint, Jr., Bayfield, CO (US)

(73) Assignees: The Board of Trustees of the Leland Stanford Junior University, Palo Alto, CA (US); Southern Ute Indian Tribe, Ignacio, CO (US)

( * ) Notice: Subject to any disclaimer, the term of this patent is extended or adjusted under 35 U.S.C. 154(b) by 470 days.

(21) Appl. No.: 13/200,999

(22) Filed: Oct. 5, 2011

(65) Prior Publication Data

US 2012/0018151 A1 Jan. 26, 2012

Related U.S. Application Data

(63) Continuation-in-part of application No. 13/068,917, filed on May 24, 2011, now abandoned.

(60) Provisional application No. 61/396,355, filed on May 25, 2010.

(51) Int. Cl.
*A62C 2/00* (2006.01)

(52) U.S. Cl.
USPC ..... 169/46; 169/64; 299/12

(58) Field of Classification Search
USPC ..... 299/12; 169/60, 64, 45–47
See application file for complete search history.

(56) References Cited

U.S. PATENT DOCUMENTS

| | | | | |
|---|---|---|---|---|
| 3,421,587 | A * | 1/1969 | Jones et al. | 169/46 |
| 3,500,934 | A * | 3/1970 | Magnuson | 169/46 |
| 3,927,719 | A * | 12/1975 | Maser | 169/46 |
| 7,104,336 | B2 * | 9/2006 | Ozment | 169/44 |
| 7,334,644 | B1 * | 2/2008 | Ozment | 169/46 |
| 7,682,107 | B2 * | 3/2010 | Crayne et al. | 405/263 |
| 8,096,622 | B2 * | 1/2012 | Hussey | 299/12 |
| 8,397,829 | B2 * | 3/2013 | Brown | 169/46 |
| 8,460,570 | B2 * | 6/2013 | Elliott | 252/2 |

* cited by examiner

*Primary Examiner* — Sunil Singh
(74) *Attorney, Agent, or Firm* — Lumen Patent Firm

(57) ABSTRACT

A method of locating and controlling subsurface coal fires is provided that includes mapping a subsurface coal bed fire using a magnetometer, where the mapping includes locating a combustion zone and an air inlet to the combustion zone of the coal bed fire, drilling an injection port from the earth surface to a previously burned zone of the combustion zone, where the injection port is disposed between the air inlet and the combustion zone, inserting a tube in the injection port, where the tube has an exterior tube seal disposed around the tube, and the exterior tube seal isolates the earth surface from the combustion zone along an exterior of the tube. The method further includes injecting an inert gas through the tube to the combustion zone, where the inert gas controls the combustion zone of the coal bed fire.

17 Claims, 3 Drawing Sheets

INERT GAS INJECTION TO HELP CONTROL OR EXTINGUISH COAL FIRES

CROSS-REFERENCE TO RELATED APPLICATIONS

This application is a continuation-in-part of U.S. patent application Ser. No. 13/068,917 filed May 24, 2011 now abandoned, which is incorporated herein by reference. The U.S. patent application Ser. No. 13/068,917 filed May 24, 2011 claims priority from U.S. Provisional Patent Application 61/396,355 filed May 25, 2010, which is incorporated herein by reference.

FIELD OF THE INVENTION

The invention relates to underground coal fire control. More particularly, the invention relates to methods and designs for controlling or extinguishing subsurface coal fires.

BACKGROUND OF THE INVENTION

Sub-terrain coal fires are a dangerous world-wide phenomenon. A sub-terrain coal fire may be ignited naturally and burn for decades, resulting in fissures that emit thousands of metric tons of $CO_2$ to the atmosphere and burning thousands of metric tons of useable coal. What is needed is a method of controlling and extinguishing sub-terrain coal bed fires.

SUMMARY OF THE INVENTION

To address the needs in the art, a method locating and controlling subsurface coal fires is provided that includes mapping a subsurface coal bed fire using a magnetometer, where the mapping includes locating a combustion zone and an air inlet to the combustion zone of the coal bed fire, drilling an injection port from the earth surface to a previously burned zone of the combustion zone, where the injection port is disposed between the air inlet and the combustion zone, inserting a tube in the injection port, where the tube has an exterior tube seal disposed around the tube, and the exterior tube seal isolates the earth surface from the combustion zone along an exterior of the tube. The method further includes injecting an inert gas through the tube to the combustion zone, where the inert gas controls the combustion zone of the coal bed fire by excluding air from said combustion zone.

According to one embodiment of the invention, the mapping is used for site selection, where the site selection includes using magnetometer results, gas composition results, fissure mapping results, temperature results, or log results from drilling to determine a location for the injection ports with respect to the combustion zone of the coal bed fire. In one aspect, the gas composition results are used to distinguish between burning regions in the coal bed fire and air saturated regions in the coal bed fire. In a further aspect, the temperature results are used to differentiate between the burned and unburned regions, where temperatures results that are above ambient temperatures denote some combustion activity. According to another aspect, the fissure mapping results are differentiated based on thermal signatures and physical characteristics, where the physical characteristics comprise fissure aperture, fissure length, fissure type, and fissure orientation. In yet another aspect, the log results are used to confirm the magnetometer results, where the log results comprise well logs and drillers' logs. In a further aspect, the log results are used to determine locations of the injection ports, where at least two log results are used to differentiate between burned and unburned regions in the coal bed fire.

According to another embodiment of the invention, the mapping includes using a cesium-vapor magnetometer to delineate boundaries of current and previous burn regions in the coal bed fire.

In another embodiment of the invention, the mapping includes using a magnetometer to distinguish areas of relatively high, relatively low, and relatively neutral magnetic anomaly regions when compared to the earth's magnetic field strength. In one aspect, the relatively high magnetic anomaly regions outline areas where the coal bed fire has previously burned, where the relatively low magnetic anomaly regions outline areas where the coal bed fire is currently burning, and where the relatively neutral magnetic anomaly regions outline unburned coal seams.

According to another embodiment of the invention, the mapping includes drilling boreholes below currently burning, previously burned, or unburned regions in the coal bed fire, where gas samples are collected there from.

In yet another embodiment of the invention, the mapping includes using subsurface thermocouples disposed in the coal bed fire, or disposed above the coal bed fire for measuring the temperatures in subsurface regions.

According to one embodiment of the invention, bentonite chips are disposed to fill the region above the isolator seal up to the Earth's surface, where the bentonite chips seal off any flow paths up along the injection port to the Earth's surface.

In a further embodiment of the invention, injecting the inert gas includes identifying and characterizing a dominant exhaust fissure exhausting gas from the coal fire bed, where the characterizing includes estimating a flux of the exhaust gas using assumptions about length of the dominant exhaust fissure and surface roughness coefficients of the dominant exhaust fissure. In one aspect, the characterization is corroborated using a volatile organic compound digital camera (VOC camera) to measure a rate of an exhaust plume exiting the dominant exhaust fissure, where a plume velocity, and dominant exhaust fissure dimensions, are used to estimate the exhaust gas flux, where a rate of the inert gas supplied through the injection port is determined.

According to a further embodiment of the invention, stable isotope measurements are made at an exhaust fissure from the coal fire, where the isotope measurements are used to determine the presence of the injected inert gas.

In yet another embodiment of the invention, the injected inert gas can include He, Ne, Ar, Kr, Xe, Rn, $SF_6$, $N_2$ or $CO_2$.

DETAILED DESCRIPTION

The current invention includes a field-scale inert gas injection system to control and/or extinguish coal fires. According to one embodiment of the invention, several steps are required that include determining proper locations for inert gas injection ports at the coal fires, forming appropriate inert gas injection ports, determining the rate of inert gas injection required for effectively suffocating the coal bed fire, and monitoring the path of the injected gas, and monitoring the effectiveness of the fire mitigation.

Figure 1:
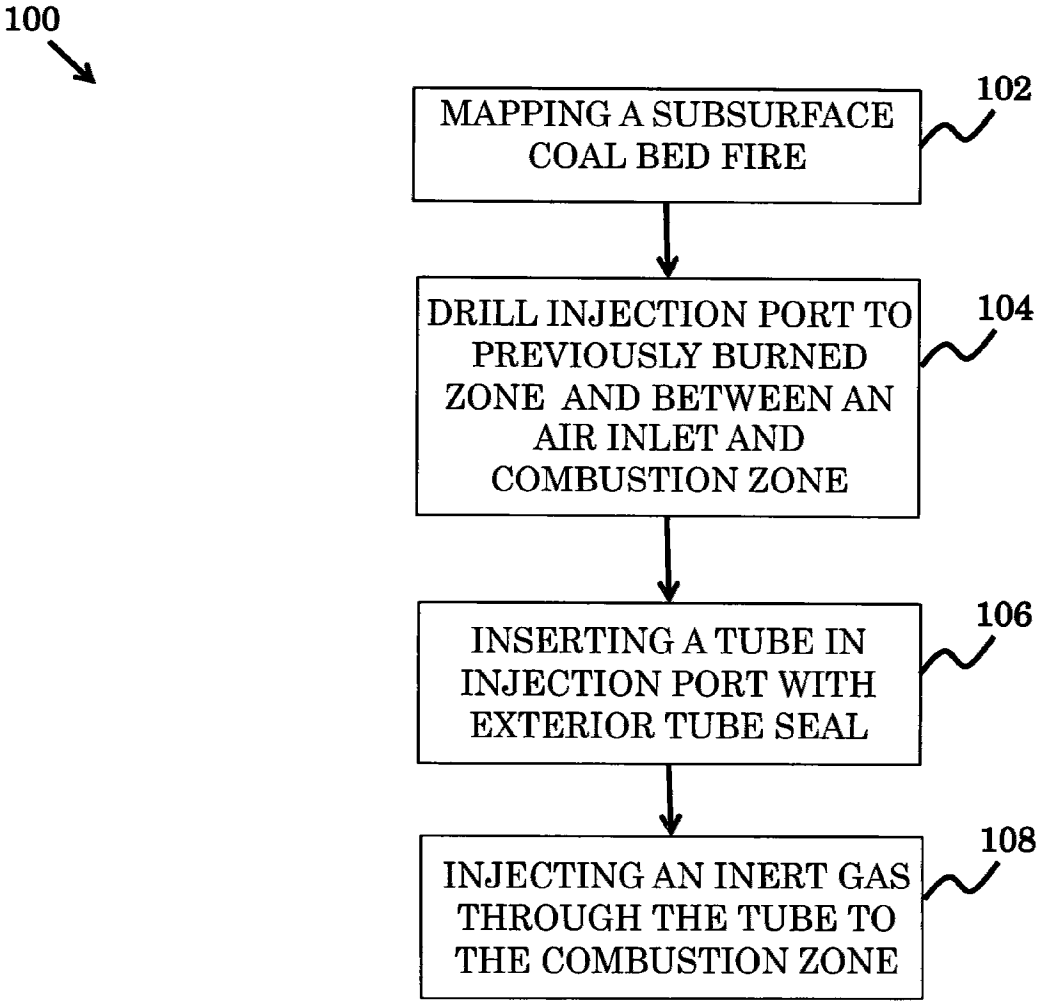
FIG. 1 shows a flow diagram of the method of controlling and extinguishing sub-terrain coal bed fires, according to one embodiment of the invention.

FIG. 1 shows a flow diagram 100 of the method of controlling and extinguishing sub-terrain coal bed fires, according to one embodiment of the invention. The method includes mapping a subsurface coal bed fire 102, drilling an injection port 104 to a previously burned zone of a combustion zone and disposed between an air inlet an the combustion zone, inserting a tube 106 in the injection port with an exterior seal, and injecting an inert gas 108 through the tube to the combustion zone.

The site selection includes using magnetometer results, gas composition results, fissure mapping results, temperature results, or log results from drilling to determine a location for the injection ports with respect to the combustion zone of the coal bed fire. Here, the mapping of the subsurface coal bed fire using a magnetometer allows for determining the injection port site, where the mapping includes locating a combustion zone and an air inlet to the combustion zone of the coal bed fire. According to another embodiment of the invention, the magnetometer is a cesium-vapor magnetometer that is used to delineate boundaries of current and previous burn regions in the coal bed fire. Further, the magnetometer is used to distinguish areas of relatively high, relatively low, and relatively neutral magnetic anomaly regions when compared to the earth's magnetic field strength, where the relatively high magnetic anomaly regions outline areas where the coal bed fire has previously burned, the relatively low magnetic anomaly regions outline areas where the coal bed fire is currently burning, and the relatively neutral magnetic anomaly regions outline unburned coal seams.

The mapping includes drilling boreholes below the currently burning, previously burned, or unburned regions in the coal bed fire, where gas samples can be collected for analysis. The gas composition results are used to distinguish between burning regions in the coal bed fire and air saturated regions in the coal bed fire.

The mapping further includes using subsurface thermocouples deployed down to the coal seam or several feet over the coal seam to measure the temperature in the subsurface regions. The temperature results are used to differentiate between the burned and unburned regions, where temperature results that are above ambient temperatures denote some combustion activity. Temperatures that are over ambient temperatures denote some combustion activity. Temperature results on its own can be used as a way to site injection port locations, but a high density of temperature results will be required to differentiate between the burned and unburned regions.

Figure 2A:
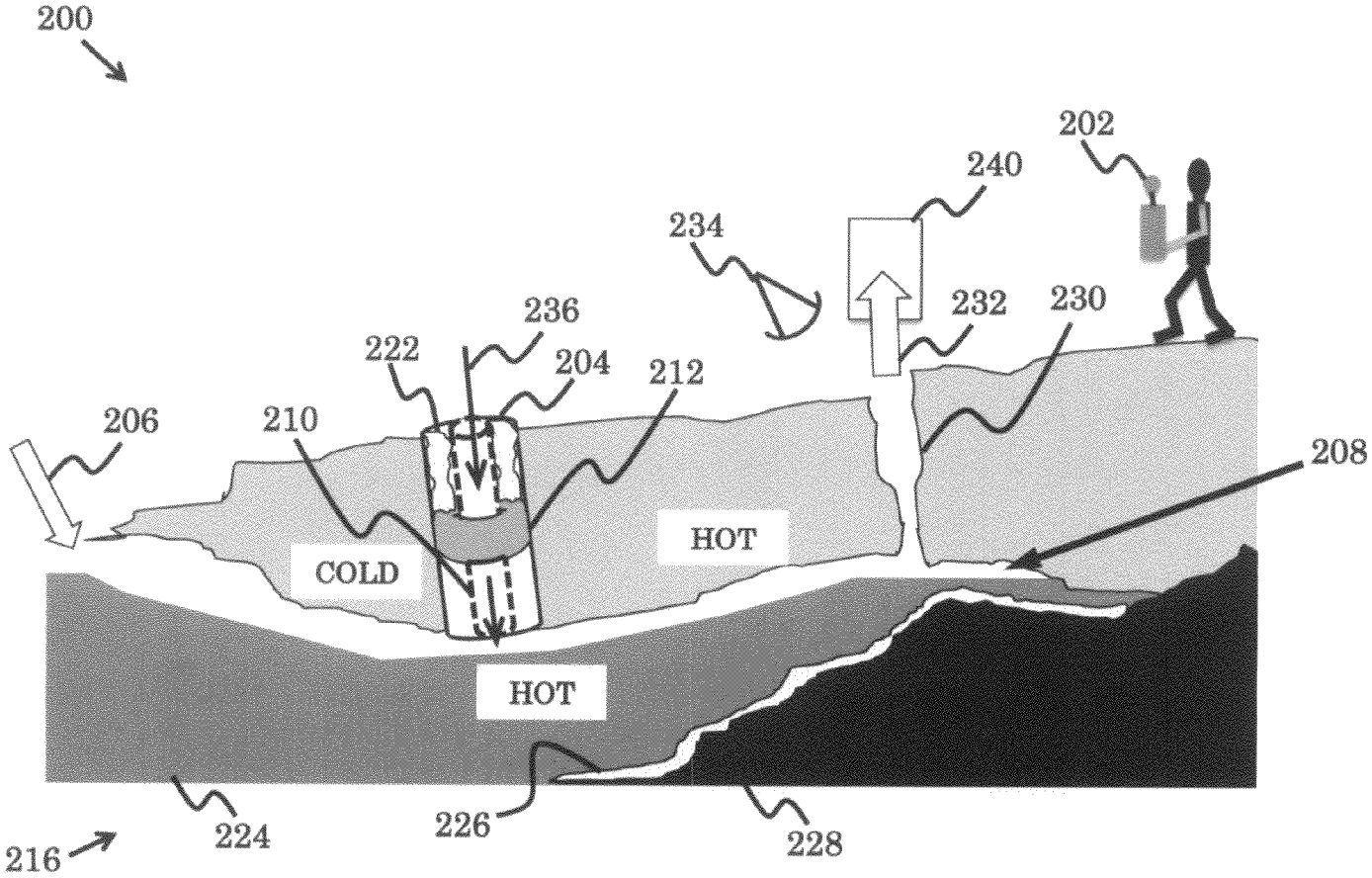
FIG. 2*a* shows a schematic drawing of a method of controlling and extinguishing sub-terrain coal bed fires, according to one embodiment of the invention.
Figure 2B:
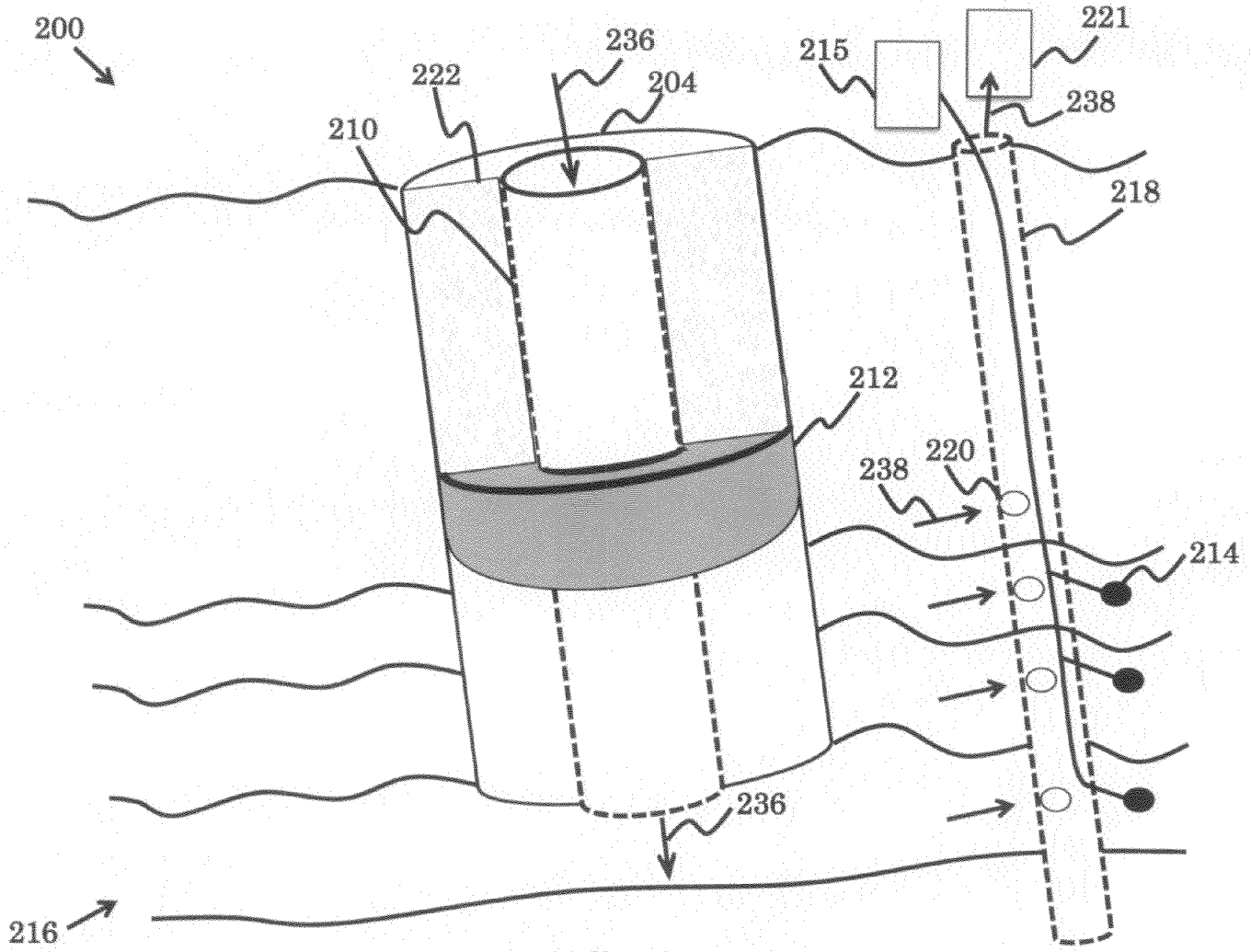
FIG. 2*b* shows a schematic drawing of an injection port for controlling and extinguishing sub-terrain coal bed fires and a borehole for sample collection, according to one embodiment of the invention.

FIGS. 2*a*-2*b* show a schematic drawings of a method of controlling and extinguishing sub-terrain coal bed fires 200, according to one embodiment of the invention. In FIG. 2*a*, the a magnetometer 202 is used to determining the locations of injection ports by distinguishing areas of relatively high, relatively low, and relatively neutral magnetic anomaly regions when compared to the ambient magnetic field strength. An injection port 204 is disposed between the air inlet 206 and the combustion zone 208, and a tube 210 is inserted in the injection port 204. Shown in FIGS. 2*a*-2*b*, the tube 210 has an exterior tube isolator seal 212 disposed around the tube 210, where the exterior tube isolator seal 212 isolates the earth surface from the combustion zone 208 along an exterior of the tube 210. FIG. 2*b* shows subsurface thermocouples 214 deployed down to the coal seam 216 or several feet over the coal seam through a borehole 218 to measure the temperature 215 in the subsurface regions. Additionally shown in FIG. 2*b* are gas ports 220 in the borehole 218 for obtaining gas composition measurements 221, where the results are used to distinguish between burning regions in the coal bed fire and air saturated regions in the coal bed fire. According to one embodiment, back fill material 222, for example bentonite chips, are disposed to fill the region above the isolator seal 212 to seal off any flow paths up along the injection port 212 to the Earth's surface.

Returning to FIG. 2*a*, the coal bed seam 216 includes a previously burned region 224, a currently burning region 226 and an unburned region 228. Further shown is the process of identifying and characterizing a dominant exhaust fissure 230 exhausting gas 232 from the coal fire bed 216, where the characterizing includes estimating a flux of the exhaust gas using assumptions about length of the dominant exhaust fissure 230 and surface roughness coefficients of the dominant exhaust fissure 230. In one aspect, the characterization is corroborated using a volatile organic compound digital camera 234

(VOC camera) to measure a rate of an exhaust plume 232 exiting the dominant exhaust fissure 230, where a plume velocity, and dominant exhaust fissure dimensions, are used to estimate the exhaust gas flux, where a rate of the inert gas 236 supplied through the injection port 204 is determined. The inert gas 236 through the tube 210 to control the combustion zone 226 of the coal bed fire can include He, Ne, Ar, Kr, Xe, Rn, $SF_6$, $N_2$ or $CO_2$.

According to another aspect, the fissure mapping results are differentiated based on the thermal signatures and physical characteristics, where the physical characteristics include fissure aperture, fissure length, fissure type, and fissure orientation.

By using the CV-magnetometer 202, the invention achieves relatively high-resolution of the fire boundaries. With use of the magnetometer 202 in conjunction with other field data, appropriate locations for the inert gas injection ports 204 with respect to the fire are selected.

While the CV-magnetometer 202 measurements highlight areas of contrasting magnetic anomalies, gas composition data are used to complement the magnetometer data. Gas composition results can help distinguish between subsurface regions that are currently burning and areas that are saturated with air. Gas samples 238 (see FIG. 2*b*) are collected from boreholes 218 that are drilled from the surface down to several feet below the burning, burned, or unaltered, coal seam.

Fissure mapping results are used to obtain the distribution of fissures over a coal fire area distinguish combustion gas vents, and possible $O_2$ inlet points. Fissures are differentiated based on thermal signatures and other physical characteristics, including, but not limited to, aperture, length, type, and orientation.

Driller's logs and well logs are used to supplement the magnetometer results. The logs confirm results from the magnetometer results. Well logs and drillers' logs alone can be used to site injection ports, although a high density of logs will be required to differentiate between burned 224 and unburned regions 228. In yet another aspect, the log results are used to confirm the magnetometer results, where at least two log results are used to differentiate between burned and unburned regions in the coal bed fire.

Injection ports 204 must be located in a location that at least one of the following:

1. The injection port 204 must lie in between air inlets 206 and the combustion zone 208.

2. The subsurface temperature must be below the temperature threshold that can be withstood by a typical drilling bit.

3. The injection port 204 must be located in a previously burned zone 224.

In one embodiment of the invention, the first requirement can be results obtained from both the field data and site characterizations. Heavily fissured surfaces indicate regions that have been or are currently being affected by the subsurface coal fires. Hot fissures indicate active combustion below, while colder fissures are likely locations through which air is entering the subsurface to feed the combustion zone. To replace the flow of air 205 from inlet sources to the combustion zone 208 with inert gas 236, the injection port 204 must be located in between the hot and cold fissures (see FIG. 2*a*).

The second requirement is addressed by using a combination of subsurface thermocouple temperature readings 215 and measured magnetic anomalies over the coal bed fire. Magnetic anomalies differentiate between regions that have been previously burned and regions that are currently active.

The third requirement is met by drilling in an area where high magnetic anomalies are detected by the CV-magnetometer 202.

Drilling and completing an injection port 204 includes drilling several feet past the coal seam 216, inserting the tube 210 with a smaller diameter and a tube seal 212 placed at an appropriate length down the tube 210, where the tube seal 212 does not have to be at the end of the tubing 210, but it must be located such that when the tubing 1220 is inserted down the injection port 204, the tube seal 212 can be set in ordered to isolate the fractured zone above the burned/burning coal seam. Then the back fill 222 fills the region above the tube seal 212 up to the surface in order to seal off potential flow paths up the injection port 204 to the surface, and the smaller diameter tubing 210 may or may not extend down to the entire depth of the coal seam 216.

Once the injection port location is determined and completed, the rate at which the inert gas 236 is to be injected must be defined. The injection rate is calculated by modeling the coal fire as a convection chimney. By identifying which of the fissures above the coal fire account for the majority or a significant fraction of the flow from the subsurface, those fissures' dimensions, exhaust gas temperatures from those fissures, along with assumptions about the fissure lengths and surface roughness coefficients allow for an estimation of the flux of exhaust gases from the subsurface.

In practice, injecting the inert gas 236 includes identifying and characterizing a dominant exhaust fissure 230 exhausting gas from the coal fire bed, where the characterizing includes estimating a flux of the exhaust gas 232 using assumptions about length of the dominant exhaust fissure 230 and surface roughness coefficients of the dominant exhaust fissure. In one aspect, the characterization is corroborated using a volatile organic compound digital camera 234 (VOC camera) to measure a rate of an exhaust plume exiting the dominant exhaust fissure, where a plume velocity, and dominant exhaust fissure dimensions, are used to estimate the exhaust gas flux, where a rate of the inert gas supplied through the injection port is determined.

The exhaust gas flux is calculated using either of the methods, and can be converted to the amount of air required by the combustion zone to keep it burning by assuming char+ $O_2 \rightarrow CO_2$ chemistry. Using the fissure distribution geometry, it is possible to calculate the rate of $CO_2$ that must be supplied through the injection port.

According to a further embodiment of the invention, stable isotope measurements 240 are made at an exhaust fissure 230 from the coal fire, where the isotope measurements are used to determine a present of the injected inert gas 236. Stable isotope measurements 240 are used to determine whether the $CO_2$ is present in the gases sampled at observation wells, or if the hot gas fissure at the crest was $CO_2$ that came from the burning coal, or the $CO_2$ was from the injected gas. There are three sources of $CO_2$ from the coal bed itself, each with a different ratio of carbon 13 to carbon 12. For example, $CO_2$ from burning the Fruitland coal has a C13/C12 ratio ($\delta^{13}C$) of −26 per mil (‰, expressed as parts per thousand when compared with a standard). Further, $CH_4$ and $CO_2$ present in the produced gas from coal bed wells in the San Juan Basin show $\delta^{13}C$ values of −43‰ and +15‰ respectively. These gases are physically adsorbed onto coal surfaces rather than being chemically bound to the coal structure. The injected $CO_2$ $\delta^{13}C$ value was −5‰, and that of the $CO_2$ present in ambient air is −8‰. The differences between the values for the five potential sources of $CO_2$ were sufficient to permit onsite, real time detection of the presence of injected $CO_2$ in sampled gases using a cavity laser ringdown instrument (from Picarro, Inc.), which reports an average $\delta^{13}C$ value.

To monitor the effectiveness of any fire fighting operation, a magnetometer survey of the regions affected by the coal fire are resurveyed, and compared to the initial survey results.

The differences between the two surveys show the success or the failure of a particular firefighting scheme implemented at the site, including the inert gas injection method.

In an exemplary injection experiment, 20 tons of $CO_2$ was injected through the two completed injection ports over a coal fire. During this example experiment, $CO_2$ was never injected simultaneously through both ports. A total of 4 boreholes and up to 4 fissure locations served as observation points for any given injection test. The composition and $\delta^{13}C$ measurements that were collected during the experiment demonstrated that $CO_2$ can be injected into fractures in the layers where coal has burned previously and that the $CO_2$ injected there reaches the fissures where hot gases are being emitted. This result indicates that if enough $CO_2$ can be supplied to the fracture system that is transporting air to the combustion zone, it will replace the air that is supporting combustion now.

The invention can be extended to design a full-scale field $CO_2$ injection to suppress coal fires. While the number of wells drilled over an area must be uniquely defined, the criteria that each of the wells meet, the way in which these injection ports are completed, the injection rate at the wells, methods to monitor the injected gas, and methods to monitor the success or failure of the fire fighting efforts are defined in this invention.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. For example, the number and location of injection ports, injection rates, and the composition of the injected inert gas can be chosen to fit the requirements of a specific subsurface fire.

All such variations are considered to be within the scope and spirit of the present invention as defined by the following claims and their legal equivalents.

What is claimed:

1. A method locating and controlling subsurface coal fires, comprising:

a. mapping a subsurface coal bed fire using a magnetometer, wherein said mapping comprises locating a combustion zone of said coal bed fire and an air inlet to said combustion zone;

b. drilling an injection port from the earth surface to a previously burned zone of said combustion zone, wherein said injection port is disposed between said air inlet and said combustion zone;

c. inserting a tube in said injection port, wherein said tube comprises an exterior tube seal disposed around said tube, wherein said exterior tube seal isolates said earth surface from said combustion zone along an exterior of said tube; and d. injecting an inert gas through said tube to said combustion zone, wherein said inert gas controls said combustion zone of said coal bed fire by excluding air from said combustion zone.

2. The method according to claim 1, wherein said mapping is used for site selection, wherein said site selection comprises using magnetometer results, gas composition results, fissure mapping results, temperature results, or log results from drilling to determine a location for said injection ports with respect to said combustion zone of said coal bed fire.

3. The method according to claim 2, wherein said gas composition results are used to distinguish between burning regions in said coal bed fire and air saturated regions in said coal bed fire.

4. The method according to claim 2, wherein said temperature results are used to differentiate between the burned and unburned regions, wherein temperatures results that are above ambient temperatures denote some combustion activity.

5. The method according to claim 2, wherein said fissure mapping results are differentiated based on thermal signatures and physical characteristics, wherein said physical characteristics comprise fissure aperture, fissure length, fissure type, and fissure orientation.

6. The method according to claim 2, wherein said log results are used to confirm said magnetometer results, wherein said log results comprise well logs and drillers' logs.

7. The method according to claim 2, wherein said log results are used to determine locations of said injection ports, wherein at least two said log results are used to differentiate between burned and unburned regions in said coal bed fire.

8. The method according to claim 1, wherein said mapping comprises using a cesium-vapor magnetometer to delineate boundaries of current and previous burn regions in said coal bed fire.

9. The method according to claim 1, wherein said mapping comprises using a magnetometer to distinguish areas of relatively high, relatively low, and relatively neutral magnetic anomaly regions when compared to the earth's magnetic field strength.

10. The method according to claim 9, wherein said relatively high magnetic anomaly regions outline areas where said coal bed fire has previously burned, wherein said relatively low magnetic anomaly regions outline areas where said coal bed fire is currently burning, and wherein said relatively neutral magnetic anomaly regions outline unburned coal seams.

11. The method according to claim 1, wherein said mapping comprises drilling boreholes below currently burning, previously burned, or unburned regions in said coal bed fire, wherein gas samples are collected there from.

12. The method according to claim 1, wherein said mapping comprises using subsurface thermocouples disposed in said coal bed fire, or disposed above said coal bed fire for measuring the temperatures in subsurface regions.

13. The method according to claim 1, wherein bentonite chips are disposed to fill the region above said isolator seal up to said Earth's surface, wherein said bentonite chips seal off any flow paths up along said injection port to said Earth's surface.

14. The method according to claim 1, wherein injecting said inert gas comprises identifying and characterizing a dominant exhaust fissure exhausting gas from said coal fire bed, wherein said characterizing comprises estimating a flux of said exhaust gas using assumptions about length of said dominant exhaust fissure and surface roughness coefficients of said dominant exhaust fissure.

15. The method according to claim 14, wherein said characterization is corroborated using a volatile organic compound digital camera (VOC camera) to measure a rate of an exhaust plume exiting said dominant exhaust fissure, wherein a plume velocity, and dominant exhaust fissure dimensions, are used to estimate said exhaust gas flux, wherein a rate of said inert gas supplied through said injection port is determined.

16. The method according to claim 1, wherein stable isotope measurements are made at an exhaust fissure from said coal fire, wherein said isotope measurements are used to determine a present of said injected inert gas.

17. The method according to claim 1, wherein said injected inert gas is selected from the group consisting of He, Ne, Ar, Kr, Xe, Rn, $SF_6$, $N_2$ and $CO_2$.

* * * * *